US005435759A

United States Patent [19]

Adams et al.

[11] Patent Number: 5,435,759

[45] Date of Patent: Jul. 25, 1995

[54] JUMPER CABLE CLAMP CONSTRUCTION

[76] Inventors: Chad S. Adams, Box 312; Kirk P. Adams, Box 337, both of East Claridon, Ohio 44033

[21] Appl. No.: 208,370

[22] Filed: Mar. 10, 1994

[51] Int. Cl.[6] ..... H01R 11/12

[52] U.S. Cl. ..... 439/755; 439/577; 439/822

[58] Field of Search ..... 439/217, 219, 577, 755, 439/759, 822, 754

[56] References Cited

U.S. PATENT DOCUMENTS 4,431,925 2/1984 Frisbee et al. .
4,565,414 1/1986 French ..... 439/755
4,620,767 11/1986 Woolf ..... 439/755
4,913,668 4/1990 Chamberlain ..... 439/755
4,923,415 5/1990 Lee .
4,975,089 12/1990 Lee .
5,030,106 7/1991 Cameron et al. .
5,037,335 8/1991 Campbell .

*Primary Examiner*—Daniel W. Howell

[57] ABSTRACT

Jumper cables include at least one of the clamp members formed with cooperating first and second jaws, having first and second extension legs extending from the respective first and second jaws, with a connecting loop secured to the first and second extension legs, such that the connecting loop is formed of a spring steel construction arranged to encompass a side post terminal lug during a charging procedure, while the facing first and second jaws may alternatively secure top terminal posts.

3 Claims, 3 Drawing Sheets

JUMPER CABLE CLAMP CONSTRUCTION

BACKGROUND OF THE INVENTION

1. Field of the Invention

The field of invention relates to jumper cable construction, and more specifically relates to a new jumper cable clamp construction wherein the same provides a jumper cable clamp arranged for ease of mounting to both side post and top post terminals of vehicular batteries.

2. Description of the Prior Art

Jumper cable construction of various types are indicated in the prior art and exemplified by the U.S. Pat. Nos. 5,037,335; 4,975,089; 5,030,106; and 4,923,415, as well as the U.S. Pat. No. 4,431,925.

The instant invention attempts to overcome deficiencies of the prior art by providing for a jumper cable arranged for ease of mounting to both side post and top post terminals, and in this respect, the present invention substantially fulfills this need.

SUMMARY OF THE INVENTION

In view of the disadvantages inherent in the known types of jumper cable construction now present in the prior art, the present invention provides a jumper cable clamp construction wherein the same is arranged to permit the encircling and clamping of a side post terminal lug by a jumper cable arrangement.

To attain this, the present invention provides jumper cables which include at least one of the clamp members formed with cooperating first and second jaws, having first and second extension legs extending from the respective first and second jaws, with a connecting loop secured to the first and second extension legs, such that the connecting loop is formed of a spring steel construction arranged to encompass a side post terminal lug during a charging procedure, while the facing first and second jaws may alternatively secure top terminal posts.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new jumper cable clamp construction which may be easily and efficiently manufactured and marketed.

It is a further object of the present invention to provide a new jumper cable clamp construction which is of a durable and reliable construction.

An even further object of the present invention is to provide a new jumper cable clamp construction which is susceptible of a low cost of manufacture with regard to both materials and labor, and which accordingly is then susceptible of low prices of sale to the consuming public, thereby making such jumper cable clamp constructions economically available to the buying public.

Still yet another object of the present invention is to provide a new jumper cable clamp construction which provides in the apparatuses and methods of the prior art some of the advantages thereof, while simultaneously overcoming some of the disadvantages normally associated therewith.

Even still yet another object of the present invention is to provide a new jumper cable clamp construction which includes at least one of the clamp members formed with cooperating first and second jaws, having first and second extension legs extending from the respective first and second jaws, with a connecting loop secured to the first and second extension legs, such that the connecting loop is formed of a spring steel construction arranged to encompass a side post terminal lug during a charging procedure, while the facing first and second jaws may alternatively secure top terminal posts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
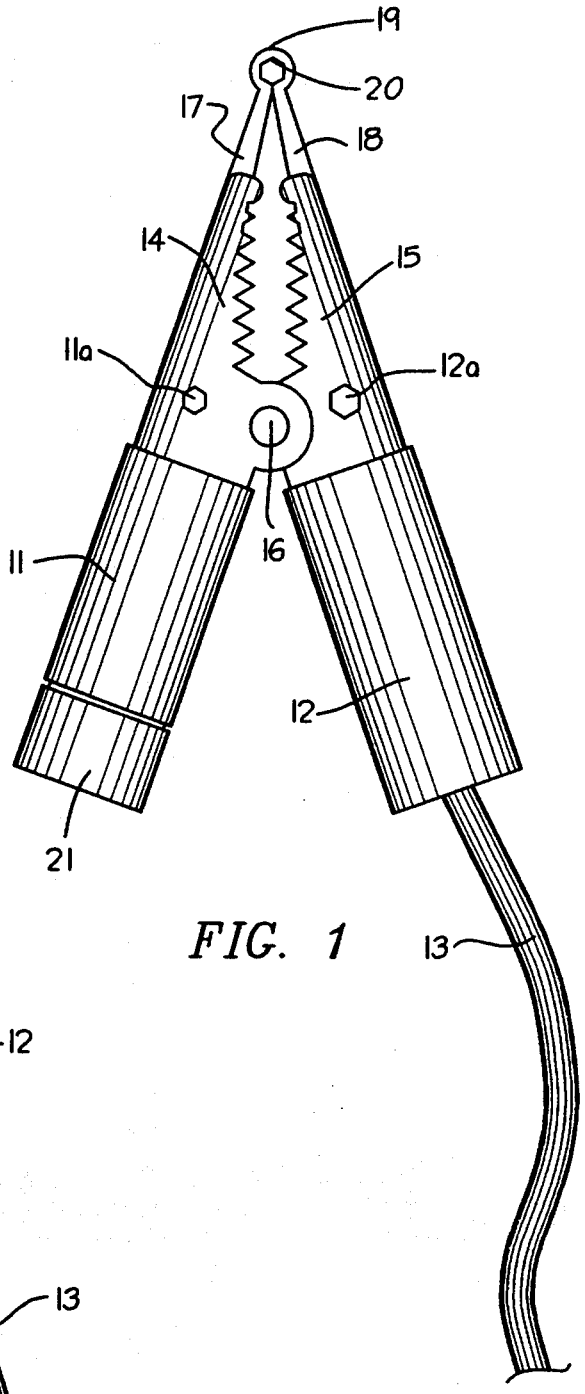
FIG. 1 is an orthographic view of the jumper cable clamp in a first closed position.

With reference now to the drawings, and in particular to FIGS. 1–5 thereof, a new jumper cable clamp construction embodying the principles and concepts of the present invention and generally designated by the reference numeral 10 will be described.

Figure 2:
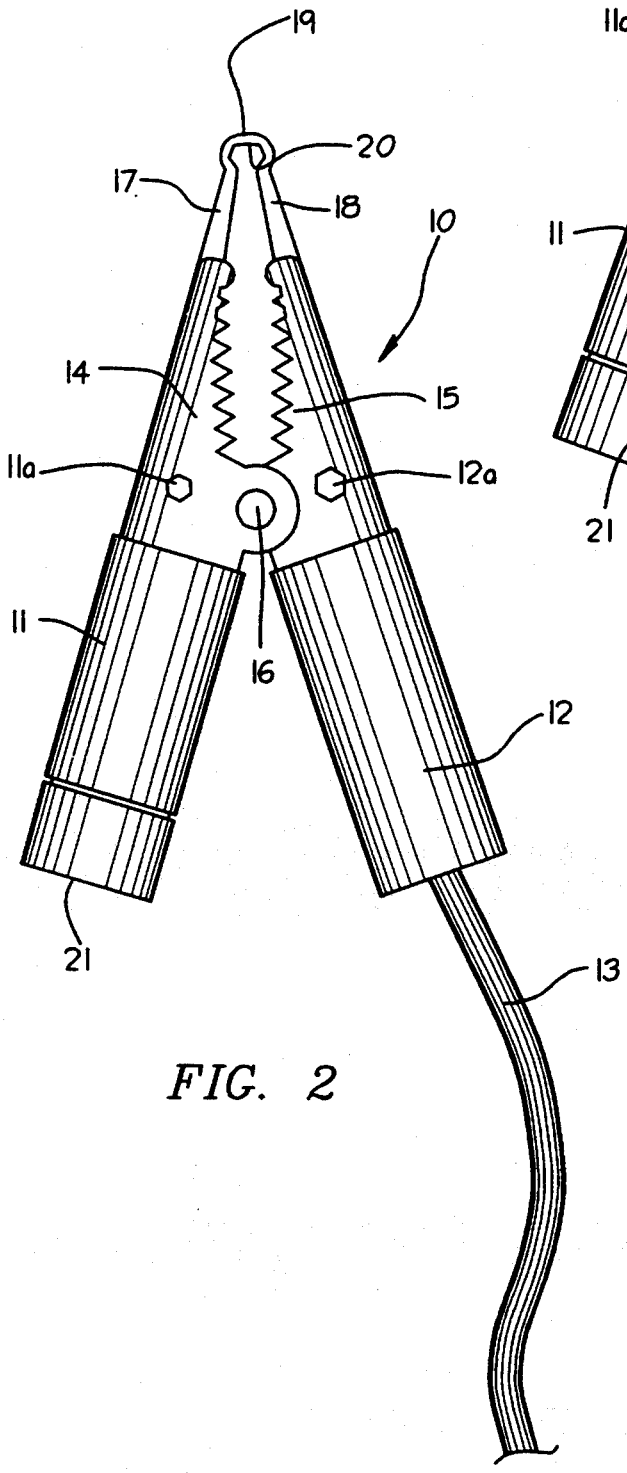
FIG. 2 is an orthographic view of the jumper cable clamp in a second opened position.

More specifically, the jumper cable clamp construction 10 of the instant invention comprises a first handle 11 of a tubular configuration, having an outer sleeve typically of a resilient, insulative construction with the first handle 11 being pivotally mounted to a second handle 12 about a pivot axle 16. The first handle 11 extends into a conductive, first jaw 14 in facing cooperation with a conductive, second jaw 15 mounted to the second handle 12, with the pivot axle oriented between the jaws and the handles, as illustrated in FIGS. 1 and 2, for example. An electrical cable 13 is directed into electrical communication with the clamp structure through the second handle 12 and in electrical communication to the second jaw 15 through the second handle 12. The jaws 14 and 15 include serrations which facilitate attachment of the device 10 to the top post of a battery or other portion of a vehicle. In addition, a first wrench aperture 11*a* cooperable with a first size of side terminal attaching means is formed within the first handle 11, and a second wrench aperture 12*a* cooperable with a second size of side terminal attaching means is formed within the second handle 12, as illustrated in FIGS. 1 and 2.

To accommodate mounting of the device 10 to the side post of a vehicle battery, a first jaw extension leg plate 17 extends from the first jaw, while a second jaw extension leg plate 18 extends from the second jaw, with a connecting loop 19 formed of a spring steel construction connecting the first and second jaw extension leg plates 17 and 18 together that are also formed of electrical communicative metallic material. A polygonal contact surface 20 is formed by an interior surface of the connecting loop 19, such that the polygonal contact surface 20 is arranged in facing relationship relative to the pivot axle 16 to secure the side post terminal of the battery when the first and second jaw extension leg plates 17 and 18 are spaced from one another from a first position in contiguous communication relative to one another relative to the encircling contact surface 20.

Figure 3:
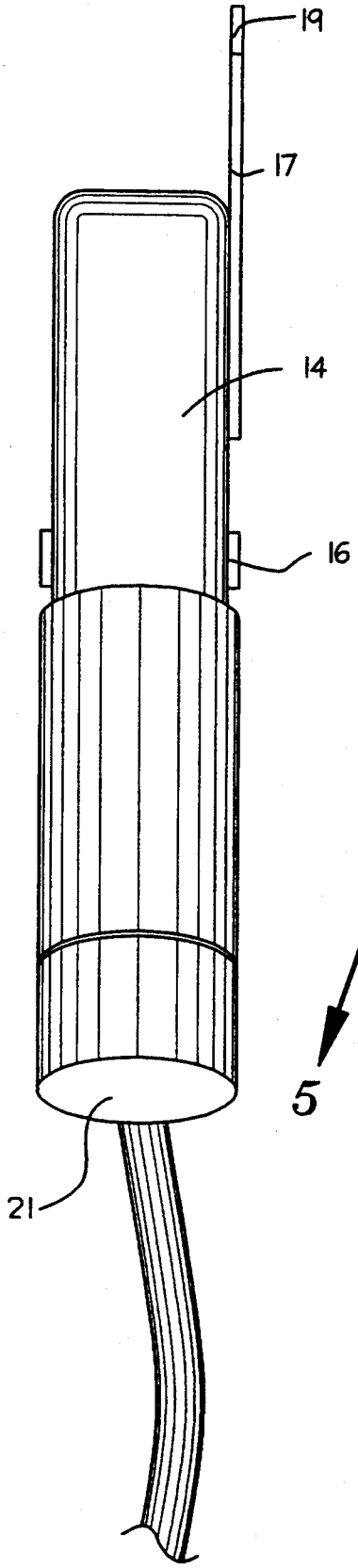
FIG. 3 is an orthographic end view of the jumper cable clamp and first handle member.
Figure 4:
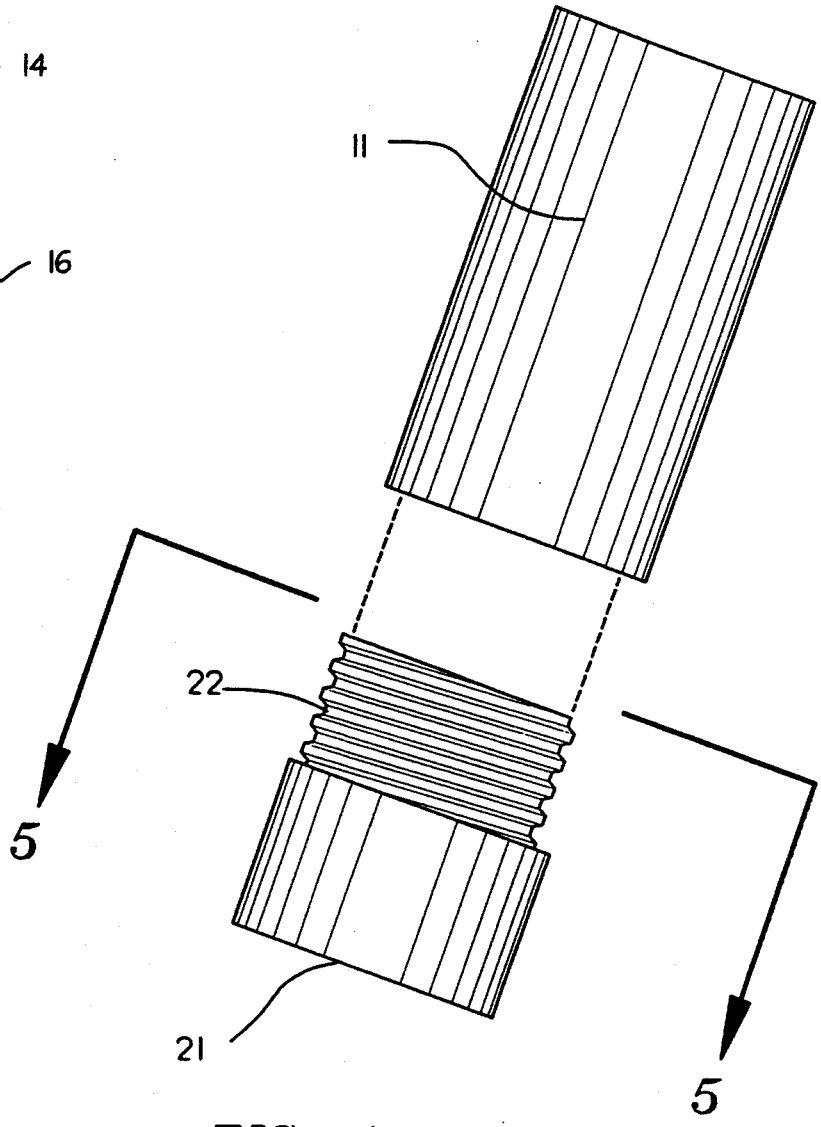
FIG. 4 is an orthographic view of the first handle member and the cap member separated therefrom.
Figure 5:
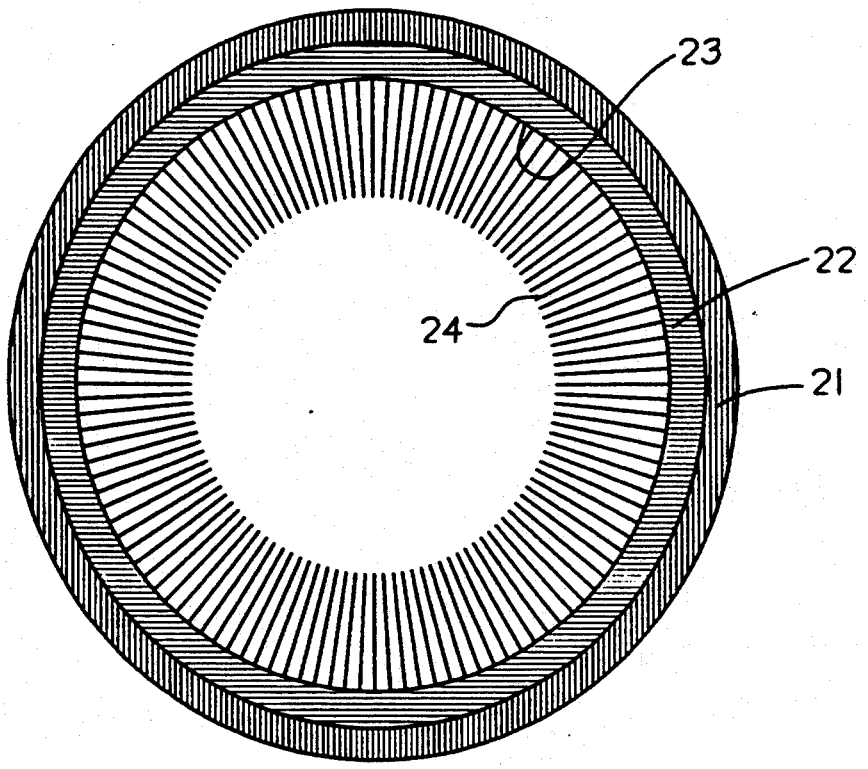
FIG. 5 is an orthographic view, taken along the lines 5—5 of FIG. 4 in the direction indicated by the arrows.

Reference to FIGS. 3, 4 and 5 indicates a first handle cap 21 as having an externally threaded skirt 22 complementarily received within the first handle 11. The first handle cap 21 includes a cap cavity interior side wall 23 having an encircling radial array of brush filaments 24 directed into the cavity and contained within the skirt 22, such as illustrated in FIG. 5.

As to the manner of usage and operation of the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A jumper cable clamp construction comprising:

a first handle having a first jaw extending therefrom in a longitudinally aligned relationship;

a second handle having a second jaw extending therefrom in a longitudinally aligned relationship;

a pivot axle pivotally mounting the first handle and the second handle relative to one another, with the first jaw and the second jaw arranged in a facing biased relationship relative to one another;

a first jaw metallic extension leg coupled to and longitudinally extending from said first jaw;

a second jaw extension leg mounted to and extending from the second jaw, wherein the first jaw extension leg and the second jaw extension leg are arranged in a coplanar relationship, with a connecting loop extending from the first jaw leg to the second jaw leg biasing the first jaw towards the second jaw, with the connecting loop being positionable over a portion of a side post terminal of a vehicle battery.

2. A damp as set forth in claim 1, wherein the connecting loop includes an interior surface defining a polygonal contact surface.

3. A clamp as set forth in claim 2, wherein the first handle includes a first handle cap removably mounted relative to the first handle, the first handle cap including an externally threaded skirt, and a cap cavity having a cap cavity side wall, the cap cavity side wall including a cylindrical radial array of inwardly directed brush filaments.

* * * * *